US008550970B2

(12) United States Patent
Panepinto et al.

(10) Patent No.: US 8,550,970 B2
(45) Date of Patent: Oct. 8, 2013

(54) APPARATUS FOR FINISHING PRODUCTS COMING OUT FROM A MACHINE FOR FOLDING AND GLUING CARDBOARD OR PAPERBOARD PRODUCTS WITH A BACK

(76) Inventors: Giuseppe Panepinto, San Carlo Canavese (IT); Roberto Emilio Gingardi, Cirie' (IT)

( * ) Notice: Subject to any disclaimer, the term of this patent is extended or adjusted under 35 U.S.C. 154(b) by 488 days.

(21) Appl. No.: 12/960,206

(22) Filed: Dec. 3, 2010

(65) Prior Publication Data

US 2011/0136640 A1 Jun. 9, 2011

(51) Int. Cl.
*B31B 1/58* (2006.01)
*B31B 1/62* (2006.01)

(52) U.S. Cl.
USPC ..... 493/141; 493/128; 493/130; 493/142; 493/178; 493/182

(58) Field of Classification Search
USPC ..... 493/141, 142, 178, 182, 441, 128, 130; 53/370.3, 207, 232
See application file for complete search history.

(56) References Cited

U.S. PATENT DOCUMENTS 2,584,855 A * 2/1952 Fergnani ..... 493/417
3,673,928 A * 7/1972 Striplin ..... 493/23
3,771,282 A * 11/1973 Flanagan ..... 53/574
3,797,370 A * 3/1974 Sawada ..... 493/168
3,850,085 A * 11/1974 Klemm ..... 493/131
3,977,306 A * 8/1976 Flynn ..... 493/31
3,992,982 A * 11/1976 Huiskes ..... 493/295
4,022,457 A * 5/1977 Marin et al. ..... 493/399
4,041,849 A * 8/1977 Tsukasaki ..... 493/436
4,196,563 A * 4/1980 Gabrielson et al. ..... 53/456
4,341,055 A * 7/1982 Williams et al. ..... 53/462
4,596,543 A * 6/1986 Reiser et al. ..... 493/91
4,741,728 A * 5/1988 Bakx ..... 493/131
5,035,683 A * 7/1991 Takeda et al. ..... 493/23
5,037,365 A * 8/1991 Breton ..... 493/18
5,090,672 A * 2/1992 Ballestrazzi et al. ..... 270/45
5,092,827 A * 3/1992 McAdam et al. ..... 493/179
5,114,392 A * 5/1992 McAdam et al. ..... 493/179
5,131,208 A * 7/1992 Paul et al. ..... 53/376.5
5,151,075 A * 9/1992 Beaulleu et al. ..... 493/179
5,217,425 A * 6/1993 Cantrell ..... 493/465
5,230,686 A * 7/1993 McAdam et al. ..... 493/23
5,800,329 A * 9/1998 Fager et al. ..... 493/417

(Continued)

FOREIGN PATENT DOCUMENTS

EP 1 593 483 11/2005
WO WO 2007/034319 3/2007

*Primary Examiner* — Hemant M Desai
*Assistant Examiner* — Gloria R Weeks
(74) *Attorney, Agent, or Firm* — Merchant & Gould P.C.

(57) ABSTRACT

An apparatus for finishing products coming out from a folding and gluing machine of cardboard or paperboard products with a back, includes a longitudinal housing for advancing the products in rows, defined by two groups (40, 41) of circular motorized right and left belts. Each group (40, 41) being made of at least three belts. An upper belt (22, 24) and a lower belt (25, 27) are wrapped around pulleys with a horizontal axis and extending parallel to the direction of advancement of the products. A lateral belt (28, 29) is wrapped around pulleys with a vertical axis and extending parallel to the direction of advancement of the products. The belts of each group (40, 41) form among them respective "C"-shaped housing which make the lateral edges of the housing along and inside which the product advances, dragged by the belts.

7 Claims, 6 Drawing Sheets

(56) References Cited

U.S. PATENT DOCUMENTS

| | | | | |
|---|---|---|---|---|
| 5,807,223 | A * | 9/1998 | Holton | 493/84 |
| 5,997,459 | A * | 12/1999 | Kruger et al. | 493/441 |
| 6,312,371 | B1 * | 11/2001 | Long | 493/434 |
| 6,503,181 | B1 * | 1/2003 | Pons | 493/130 |
| 6,508,044 | B2 * | 1/2003 | Suolahti | 53/139.7 |
| 6,712,748 | B2 * | 3/2004 | Trennepohl | 493/423 |
| 6,962,558 | B2 * | 11/2005 | Dalrymple | 493/309 |
| 7,258,655 | B2 | 8/2007 | Saro et al. | |
| 7,399,267 | B2 * | 7/2008 | Moen | 493/463 |
| 7,670,274 | B2 * | 3/2010 | Diehr et al. | 493/182 |
| 7,708,679 | B2 * | 5/2010 | Cailloux et al. | 493/401 |
| 8,033,975 | B2 * | 10/2011 | Wiklund | 493/438 |
| 8,241,195 | B2 * | 8/2012 | Yamazaki et al. | 493/441 |
| 2002/0142907 | A1 * | 10/2002 | Merkli | 493/423 |
| 2003/0066871 | A1 * | 4/2003 | Dalrymple | 229/191 |
| 2011/0294637 | A1 * | 12/2011 | Muller et al. | 493/23 |

* cited by examiner

APPARATUS FOR FINISHING PRODUCTS COMING OUT FROM A MACHINE FOR FOLDING AND GLUING CARDBOARD OR PAPERBOARD PRODUCTS WITH A BACK

BACKGROUND OF THE INVENTION

The invention refers to an apparatus for finishing products coming out from a machine for folding and gluing cardboard or paperboard products with a back.

With cardboard or paperboard products with a back, the simple folders are meant, provided with document-carrying pockets, for discs, CD, DVD etc.

Machines are known which perform the folding of the preformed cardboard or paperboard (punched) sheets, the application on the suitably made glue strips and the gluing of the suitable parts for obtaining the finished product. Often these machines make products with defects which can be of low but also of unacceptable entity. These defects consist in that the backs which should be kept in a vertical position by the glue actually at the end of the production are not properly vertical but inclined to the vertical.

This is due to the fact that the glue has not completely hardened before the product coming out of the machine, and therefore the folded parts have the time to be slightly released before the glue takes hold completely.

On the other hand, the glue must not take hold too rapidly because otherwise it would harden before the bonding operations come to the end, which would cause still greater damages.

In certain cases the inclination with respect to the vertical of the backs is acceptable as it is scarcely visible to the naked eye; in other cases, say in most cases, this inclination is clearly visible and also is visible the open space which is seen through the corners between back and back which are not perfectly aligned along the vertical. Attempts were made to overcome such production defects, normally by changing the characteristics of taking hold of the used glue, but the results have been found to be unsatisfactory.

SUMMARY OF THE INVENTION

Aim of the invention is to propose an apparatus permitting to obtain perfect products, in which the backs are vertically aligned, so that hollow spaces even of small dimensions from one back to the other cannot be seen at the edges of the products.

For these and further aims which will be better comprised in the following, the invention proposes to realize an apparatus for the finishing of products coming out of a machine for folding and gluing cardboard and paperboard products with a back, characterized in that it comprises a longitudinal housing for advancing the products in rows, defined by two groups of circular right and left motorized belts, each group being made by at least three belts, of which an upper and a lower belt are wrapped around pulleys with an horizontal axis and extending parallel to the direction of advancement of the products, and a lateral belt is wrapped around pulleys with a vertical axis and with an extension parallel to the advancing direction of the products; the belts of each group forming between them respective "C"-shaped housings, which form the lateral edges of such housing along which and inside which said product advances, dragged by the bands.

BRIEF DESCRIPTION OF THE DRAWINGS

The invention will now be described with reference to the annexed drawings, in which.

DETAILED DESCRIPTION

Figure 2:
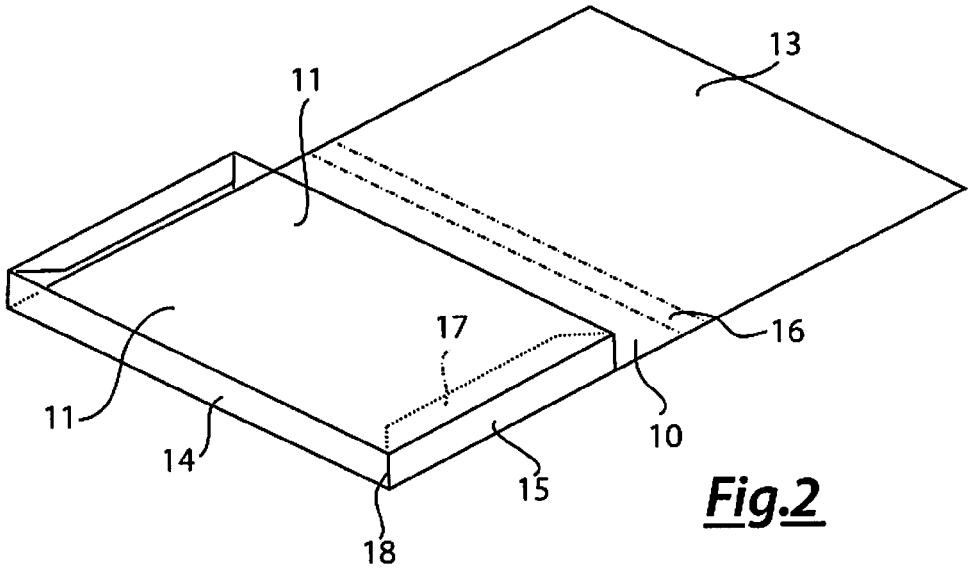
FIGS. 1 and 2 are front open and perspective closed views of an example of a folder which can be worked with the apparatus according to the invention.
Figure 1:
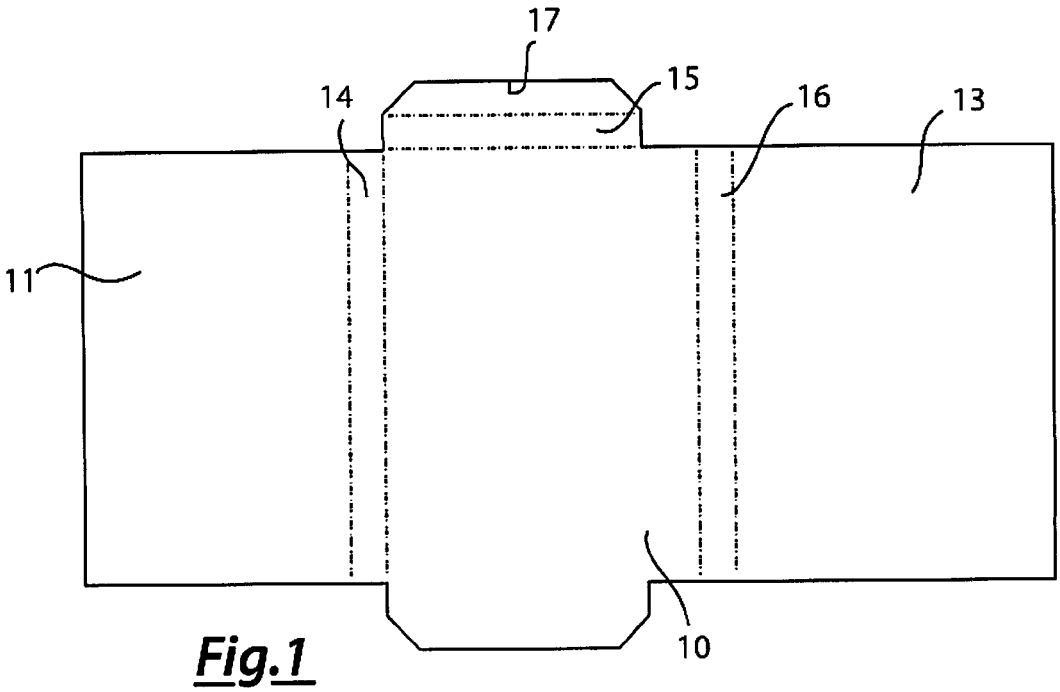

An example of a cardboard or paperboard pre-punched sheet is shown in FIG. 1; after the folding and the gluing it must be as shown in FIG. 2.

The sheet has a back 10, a front 11 and a closure front 13. In order to receive documents, sheets etc., when it has been completed, the folder has one front backs 14, two side backs 15 and one rear back 16.

Side backs 15 have also protrusions 17 which once folded are covered with glue in order to adhere from the inside to the side edges of front 11.

Figure 3:
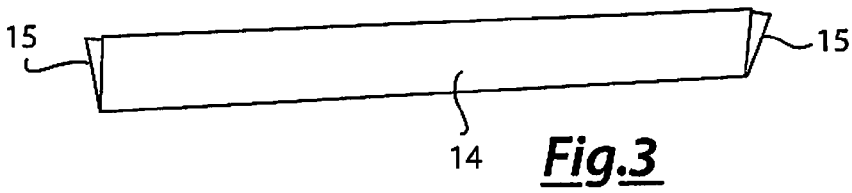
FIG. 3 is the front view of the folder of FIGS. 1 and 2 as it can be presented at the entrance of the apparatus according to the invention.

As said the problem consists in avoiding that backs 14 and 15 remain totally or even just partially inclined with respect to the vertical (see FIG. 3) after the folding and the gluing, and such open spaces remain visible along edges 18, so that in the worst cases even all what is present inside the folder can be seen.

In any case, the view of the folded backs makes the product unpleasant to the sight.

Apparatus 20 (FIG. 3) according to the invention is placed downwards a traditional machine which makes the folding, gluing and forming of the folder for instance of FIG. 2 starting from the sheet of FIG. 1.

Figure 4:
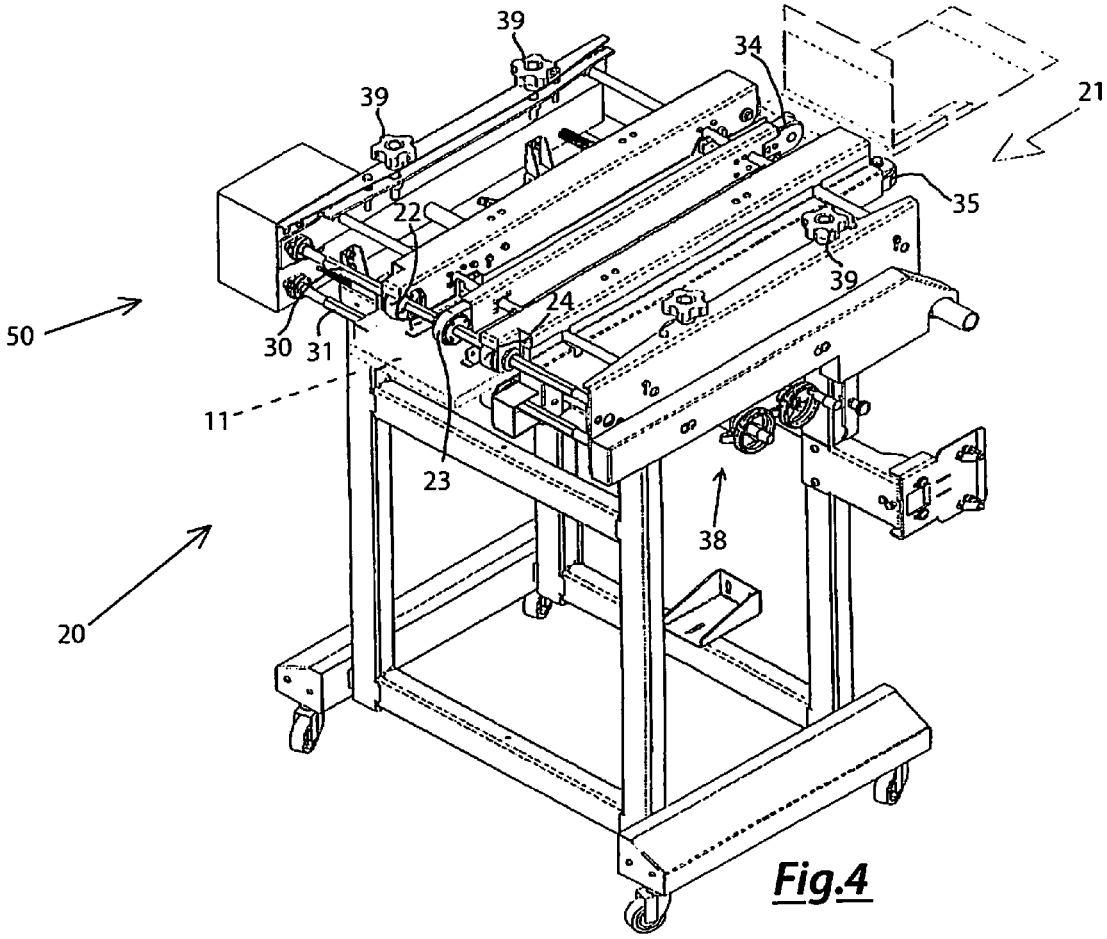
FIGS. 4 and 5 are the perspective and front views of the apparatus according to the invention.
Figure 5:
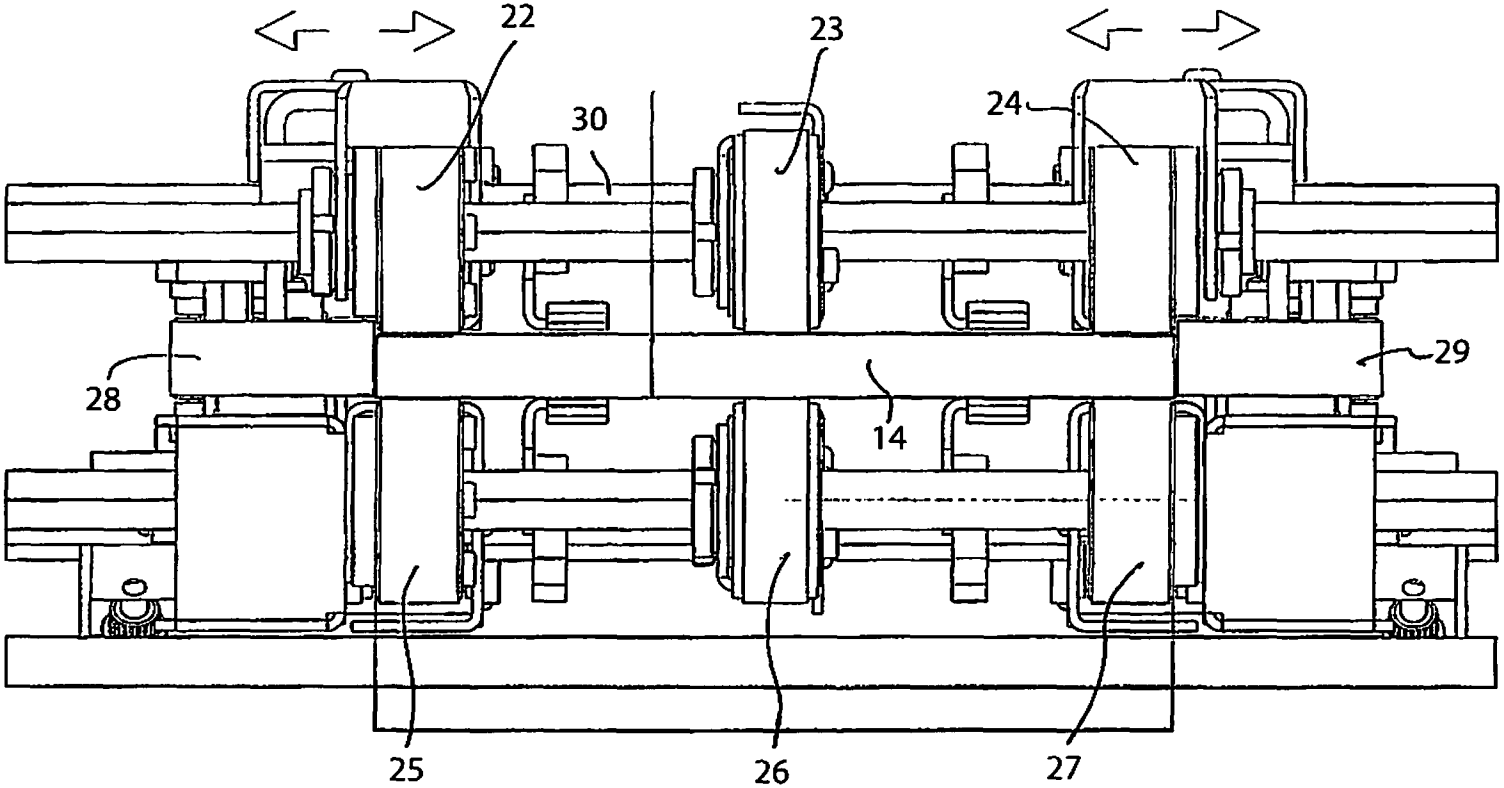

The folder enters from feeder 21 in the apparatus made by a linear housing of advancement provided among three series of conveyor belts (FIGS. 4 and 5) of which:

an upper series, formed by three parallel equally spaced bands 22, 23 and 24;

a lower series, also made by three mutually spaced parallel belts 25, 26 and 27 and corresponding to the upper ones;

a lateral series, placed between and at the sides of the two upper and lower series, and made by two belts 28 and 29.

Figure 8:
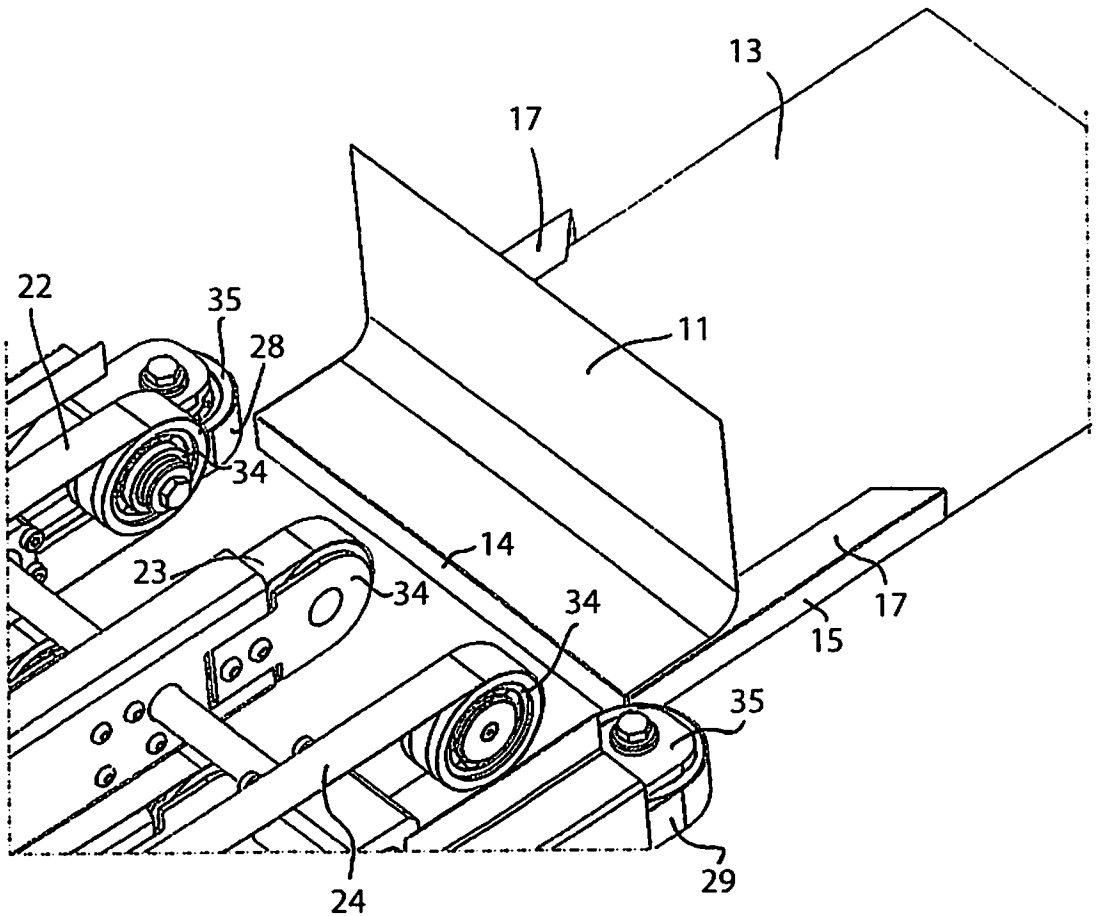
FIG. 8 is a partial perspective view of the entrance of the apparatus according to the invention.

The belts of the upper and lower row are stretched between pulleys of front shafts 30 and 31 and rear pulleys 34 clearly illustrated in FIG. 8. The pulleys of these belts are disposed with a horizontal axis perpendicular to the advancing direction of the folder, whereas the belts extend along the entire advancing longitudinal path which is identified between them.

Belts 28 and 29 of the lateral row are mounted upon front and rear pulleys 35 (in FIG. 8 only the latter ones are observed) with a vertical axis and they also develop along the entire longitudinal path of advancement of the folder. In this way between lateral upper belts 22 and 24, lateral lower belts 25 and 27 and the lateral belts a rectangular housing of variable dimensions is formed, as will be seen, in order to correspond to the transversal dimensions of the folder which as seen, enters already formed in the equipment and advances by remaining kept inside the space defined by the bands and is dragged from the belts which are also motorized.

In practice, the folder, as one can see from FIG. 8, enters in the housing of the equipment formed between belts 22-29. The belts will be regulated with mutual distances so that the housing which they will make be exactly correspondent to the transversal dimension of the theoretical folder, which instead, as one can see from FIG. 4 will have its lateral backs 15 slightly inclined outwards.

As soon as lateral bands 28 e 29 will press against lateral backs 15, if they are not vertical or just for a certain length, they will push them until reaching their complete vertical position, and the glue which in the meantime will not perfectly have dried, will permit such further correction.

Through the entire path of the folder from the entrance to the exit of the equipment the aforementioned belts will remain pressed against its backs 15, and so the folder at the exit (see FIG. 5) will be perfect as the glue in the meantime will have dried and backs 15 will be perfectly aligned along the vertical and for their entire length.

The apparatus provides means adapted to change the dimensions of the space defined by the belts, as the apparatus must be able to work every kind of folder with a dimension whatsoever.

In particular, handwheel means 38 (FIGS. 3 and 5) permit to perform the horizontal regulation of right 40 and left 41 groups, that is the mutual distance of right bands 22, 25 e 28 with respect to left ones 24, 27 and 29 in function of the length of the folder to be worked.

In particular, a worm 44 meshing with threaded bushings 45, fastened to groups 40 and 41 translates these with mutual removal and approach. Furthermore, handwheel means 39 (FIGS. 3 and 5) permit to vertically regulate right 40 and left 41 groups, that is the mutual vertical distance of upper belts 22, 23 and 24 with respect to lower ones 25, 26 and 27 in function of the height of back 14 of the folders to be worked. In particular, threaded pin 46 of handwheel 39 is screwed into a bushing 47 of frame 48 supporting upper shafts 30.

Figure 6:
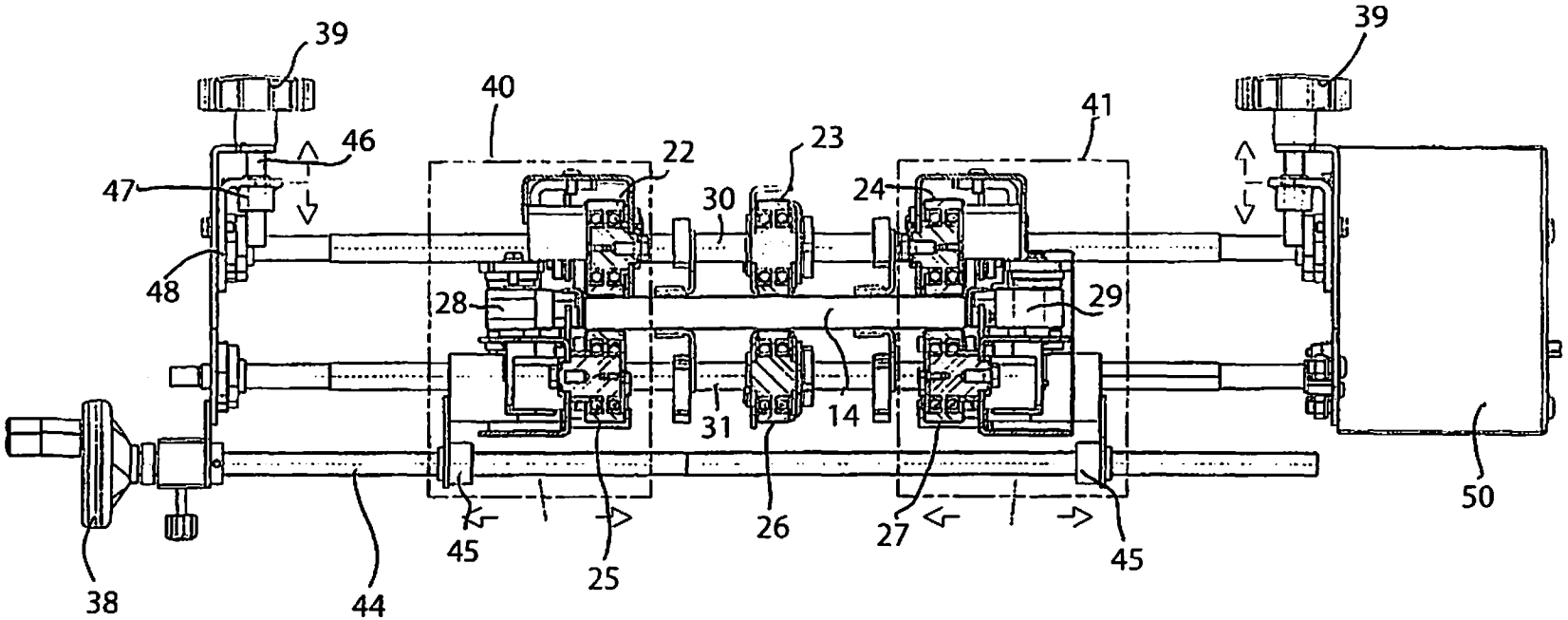
FIG. 6 is a cross-section of the apparatus according to the invention.
Figure 7:
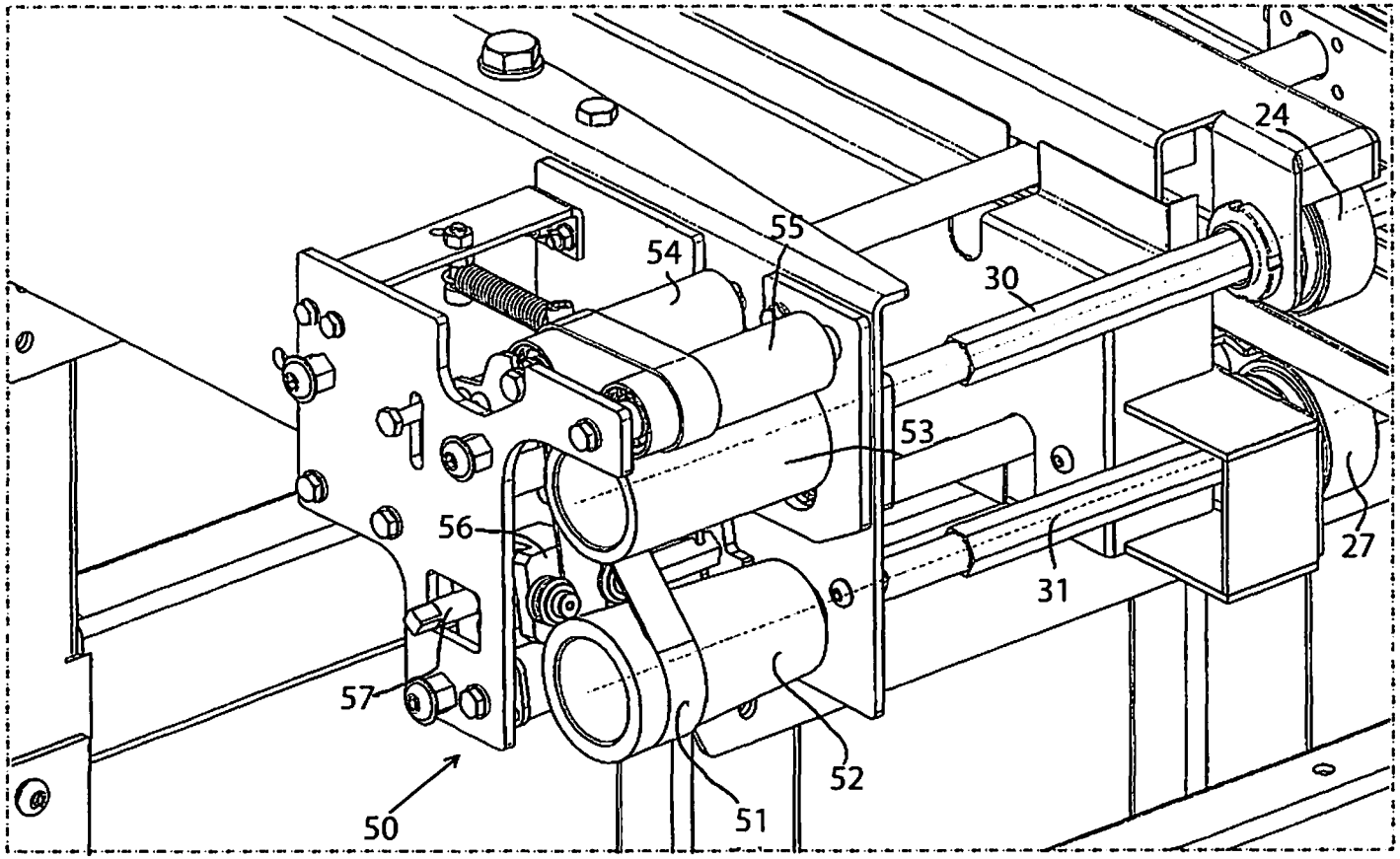
FIG. 7 is a perspective view of a detail of the apparatus according to the invention.

There is further a device (FIG. 6) adapted to change the rotation speed of lower belts 25, 26 and 27 with respect to upper belts 22, 23 and 24. Such device 50 involves the use of a belt 51 wrapped around an end 52 of shaft 31 carrying the lower bands and contacting one end 53 of shaft 30, carrying the upper bands, and around two return devices 54 and 55.

End 52 of shaft 31 is conical and belt 51 is pinched in a threaded cursor 56, in order to slide along toothed shaft 57. By means of a handwheel 58 cursor 56 is slideable, so the belt moves along end 52 so determining a variation of the speed of lower shaft 31 with respect to upper one 30.

This device has the aim to recover eventual misalignments also in frontal back 14, as at the exit of the forming machine also this can be presented inclined with respect to the vertical outwards or inwards.

By changing the mutual speed of shafts 30 and 31, and therefore of the respective belts, the dragging of the belts themselves will permit to recover this misalignment, as in the case of lateral backs 15.

The invention claimed is:

1. Apparatus for finishing products coming out from a folding and gluing machine of cardboard or paperboard products with a back, the apparatus comprising a longitudinal housing for advancing the products in rows, defined by two groups of circular motorized right and left belts, each group being made of at least three belts, of which an upper belt and a lower belt are wrapped around pulleys with a horizontal axis and extending parallel to the direction of advancement of the products, and with a lateral belt wrapped around pulleys with a vertical axis and extending parallel to the direction of advancement of the products; the belts of each group forming respective "C"-shaped housings defining lateral edges of said housing, said products advancing along and inside said housing dragged by the belts.

2. Apparatus according to claim 1, further comprising means for performing horizontal regulation of said right and left groups in function of the length of the folders to be worked.

3. Apparatus according to claim 2, wherein the means for performing horizontal regulation of said right and left groups are made by a handwheel rotating a worm meshing with threaded bushings fastened to each group.

4. Apparatus according to claim 1, further comprising means for performing vertical regulation of the right and left groups in function of the height of the back of the folders to be worked.

5. Apparatus according to claim 4, wherein the means for performing vertical regulation of the right and left groups are made by threaded pins of respective handwheels screwing into a bushing of a frame supporting the upper shafts.

6. Apparatus according to claim 1, further comprising a device adapted to change the rotation speed of the lower belts with respect to the upper belts.

7. Apparatus according to claim 6, wherein the device adapted to change the rotation speed of the lower belts with respect to the upper belts comprises a belt wrapped around an end of the shaft carrying the lower belts and contacting one end of the shaft carrying the upper belts, and around two returns the end of the shaft being conical and the belt being pinched into a threaded cursor to slide along a toothed shaft.

* * * * *